United States Patent [19]

Donaldson

[11] 4,362,972

[45] Dec. 7, 1982

[54] THYRATRONS

[75] Inventor: Timothy P. Donaldson, Great Totham, England

[73] Assignee: English Electric Valve Co. Limited, Chelmsford, England

[21] Appl. No.: 214,880

[22] Filed: Dec. 10, 1980

[30] Foreign Application Priority Data

Dec. 11, 1979 [GB] United Kingdom ..... 7942655

[51] Int. Cl.[3] ..... H01J 17/14

[52] U.S. Cl. ..... 315/338; 313/156; 313/161; 313/162; 315/56; 315/344

[58] Field of Search ..... 315/41, 42, 56, 62, 315/338, 340, 344; 313/156, 161, 162; 361/55, 120, 133

[56] References Cited

U.S. PATENT DOCUMENTS 3,519,882 7/1970 Gowar et al. ..... 315/340

FOREIGN PATENT DOCUMENTS 669971 4/1952 United Kingdom ..... 315/344

*Primary Examiner*—Eugene R. La Roche
*Attorney, Agent, or Firm*—Spencer & Kaye

[57] ABSTRACT

It is desirable not only to switch between circuits or circuit elements carrying relatively large currents but also to effect the switch-over operation extremely rapidly. Conventional thyratrons can be used to switch on the current, but they cannot easily be switched off so quickly.

The invention seeks to solve this "switch-off" difficulty by using the principle of plasma particle diversion together with a new thyratron design which can be used as a "switch-over" device. As can be seen from FIG. 1, the invention provides a thyratron having:

two cathodes (37 and 38) and one anode (34) such that there are two distinct current pathways through the thyratron having a common section of significant length; and switching means (41) for switching the current between the pathways, which switching means comprises in part magnetic-field-producing means for producing a plasma-diverting magnetic field acting at the cathode end of the common section and so as to divert the current-carrying plasma away from one and towards the other of the pathways, which magnetic-field-producing means is, preferably, an electromagnetic (solenoid type) coil mounted on and across the common section of pathway, whereby the current flowing along the one pathway is extinguished and replaced by a current flowing along the other pathway.

5 Claims, 2 Drawing Figures

THYRATRONS

BACKGROUND OF THE INVENTION

(1) FIELD OF THE INVENTION

This invention relates to thyratrons, and concerns in particular devices for the extremely rapid switching of large electric currents from one circuit to another.

(2) DESCRIPTION OF THE PRIOR ART

In certain areas of the electronics field there are many occasions—for example, in the operation of radar and allied systems—when it is desirable, for one reason or another, not only to switch between circuits or circuit elements carrying relatively large currents (possibly as large as several thousands of amps) but also to effect the switch-over operation extremely rapidly—perhaps in as little time as a few microseconds. Conventionally such currents can easily be switched on in such a short time using as the switching device a thyratron (a type of thermionic valve containing a low pressure gas which under the right conditions can be ionised within a few nanoseconds to give a plasma of very high current-carrying capacity), but unfortunately thyratrons cannot easily be switched off so quickly, and to date no entirely satisfactory rapid "switch-off" device has yet been found. As a result, it has proven difficult to obtain an acceptably rapid "switch-over" device.

Most of the efforts to find a rapid switch-off device have involved thyratrons of various types, and considerable promise has been shown by thyratrons wherein the plasma carrying the current between the thyratron's anode and cathode is caused to pass through a magnetic field so orientated as to divert the plasma particles out of the main current pathway (whereupon the through-valve current drops, the plasma is quenched, and the current is interrupted). Nevertheless, none of the thyratron designs built so far have proved entirely satisfactory as switch-over devices.

The invention seeks to solve this difficulty by using the principle of plasma particle diversion together with a new thyratron design.

SUMMARY OF THE INVENTION

In one aspect, this invention provides a thyratron having:

two cathodes and one anode, such that there are two distinct current pathways through the thyratron having a common section of significant length; and switching means for switching the current between the current pathways, which switching means comprises in part magnetic-field-producing means for producing a plasma-diverting magnetic field acting at the cathode end of the common pathway section and so as to divert the current-carrying plasma away from one and towards the other of the pathways, whereby the current flowing along the one pathway is extinguished and replaced by a current flowing along the other pathway.

The thyratron of the invention contains one anode and two cathodes. Though it might seem preferable to employ two anodes and one cathode (because the cathode, with its attendant heater element and power source, is inconvenient to supply in multiple form), nevertheless for the large currents—say, 500 amps and greater—likely to be involved it is in fact much more advantageous to use two cathodes and one anode, because, as is explained in more detail hereinafter, it is easier to divert the current-carrying plasma when the two alternate electrodes are cathodes.

The current pathways have a common section of significant length leading up to the single anode. The two together are preferably roughly Y-shaped.

The switching means acts, at least in part, by applying a diverting force to the current-carrying plasma within the thyratron; the force is applied so as to divert the plasma particles to one side of their present pathway, specifically towards the pathway which is to replace it. There are various such forces that will "couple" with a charged-particle cloud; thus, the force could be electrostatic, magnetic or electromagnetic. Electrostatic forces, through quite satisfactory for diverting purely electrons or positive ions, are generally unsuitable for diverting mixtures of the two (as is the plasma). Electromagnetic force diversion (coupling beamed electromagnetic radiation to the plasma particles so as to divert the latter by radiation pressure) is a possibility, especially using microwave radiation. Magnetic force diversion, however, is not only efficient but relatively easy to put into operation, and is therefore the method of choice, the appropriate magnetic field being applied such that its position and direction lie across the current pathway.

The diverting magnetic force is reversably directional—that is, when set up in one direction it causes the current-carrying plasma to be diverted in one direction, and when set up in the opposite direction the plasma is diverted in the opposite direction.

Exactly what happens when the diverting magnetic force is applied depends upon the details of the thyratron itself (as described hereinafter), but basically the diversion of the plasma particles out of the current pathway causes the current to be reduced, the plasma is as a result quenched, and (almost instantaneously) the current passing through the thyratron along that particular pathway (and the circuit in which it is placed) is interrupted—switched off. The switch-over operation is then completed by further action, preferably in one of two ways. Either no further magnetic field diversion is effected, and the current required in the alternative pathway is initiated in the normal fashion (thus, in one embodiment using an electrode to ionise the thyratron gas filling along at least part of the new pathway, so triggering the discharge), or before the plasma is totally quenched the magnetic field is further applied to move the plasma particles so that they now flow along the alternative pathway, the discharge along that new pathway then being initiated without the need for any extra triggering. The latter method is of particular convenience; the plasma particles can be diverted at the end of the common pathway section from one distinct pathway section to the other.

The switching magnetic field lies—at least in part—in and transverse to the current pathway, with the result that where the field is present the plasma particles will, in accordance with the natural laws as formulated by Fleming, move to the side in a direction normal both to the field direction and to the current direction. In order to ensure the largest possible magnetic field across the current pathway, it is very much preferred so to position the magnetic field source that it itself lies within the current pathway. Such a system is, in fact, described and claimed per se in the Specification of our co-pending U.S. Application No. 214,881, filed Dec. 10, 1980.

It is, of course, desirable that the particle-diverting magnetic field can be formed (and unformed) as required, and so the magnetic field source is naturally one that can itself be "switched" on and off as required. As might be expected, of the presently known ways of producing a magnetic field in a switched manner by far the most convenient is an electromagnet coil, preferably of the helical (or generally-cylindrical) nature used in solenoids, possibly slightly flattened.

When such a coil is employed as the field source, and if the coil source is itself to lie within the beam path, then certain subsidiary requirements follow. Firstly, in order to prevent the coil wire turns being shorted by the plasma, the coil must be suitably insulated by a covering of a non-conductive material (such as glass or a ceramic) impervious to the ambient conditions. Secondly, in order to cause the least physical obstruction to the plasma the coil is very desirably an open, loosely-wound coil—a coil having between adjacent turns gaps which are at least comparable in size to the size of the coil wire and its insulating covering. Thirdly, most preferably the coil is not placed squarely across the current pathway, but is instead located with its axis slightly to one side of the pathway centre line so as to cause the least possible physical obstruction to the plasma.

The current pathway—the path generally taken by the ions travelling from anode to cathode (and by electrons travelling in the opposite direction)—naturally extends between the selected anode and cathode pair, and in theory the particle-diverting magnetic field can be applied anywhere along the length of the path. In practice, however, the field must be positioned as close as possible—thus, at the junction of the two pathways—to the cathode from which the current is to be switched; there the field appears to wield the most influence. It is not clear why this should be, but it seems likely that it is in the region adjacent the cathode, where the background gas is least dense (because of the high cathode temperature), that the field can couple most efficiently with the ions. In addition, at the cathode the electrons have their lowest velocity, making them relatively easy to divert.

Apart from its two cathodes, the thyratron itself may be of any type provided only that diversion of the plasma particles can be effected so as at least to interrupt the current. Basically, however, it will be of the sort that, in addition to the conventional anode, cathode and grid along any one pathway, contains within its envelope one or more apertured control and/or screen electrodes so disposed between each anode and cathode pair as to define at least part of the pathway linking the two. In a preferred case, therefore, the thyratron of the invention comprises: an envelope containing a gas or vapour filling; a common anode and two cathodes housed within the envelope so as to define two current pathways having a common section of significant length; a plurality of control and/or screen members disposed within the envelope in the current pathway between each anode and cathode pair, and providing two or more apertures through which in operation a plasma-borne current can flow between that anode and cathode pair along that pathway; and means for producing a plasma-diverting magnetic field acting at the cathode end of the common current pathway section and so as to divert the current-carrying plasma away from one and towards the other of the pathways, whereby the current flowing along the one pathway is extinguished and replaced by a current flowing along the other pathway.

The invention extends, of course, to an electrical circuit wherein the thyratron of the invention is used as a switch, and is of particular use in circuits of the type wherein a circuit component has to be protected against a current overload (such as might be caused by internal arcing in, for example, a klystron or a travelling wave tube) by reversibly interrupting the current to that component but without switching off the power supply (which may, of course, be driving other associated components).

BRIEF DESCRIPTION OF THE DRAWINGS

An embodiment of the invention will now be described, though only by way of illustration, with reference to the accompanying drawings in which.

DETAILED DESCRIPTION

Figure 1:
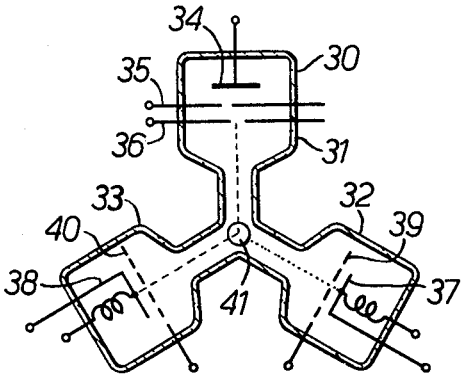
FIG. 1 is a diagrammatic cross-sectional representation of a hydrogen-filled thyratron of the invention.

The thyratron of FIG. 1 comprises an envelope (30) having three bulb-like interconnected "arms" (31,32,33) each of which contains one or more electrodes. In arm 31 is an anode 34 and two apertured control electrodes (35,36); in each of arms 32 and 33 is a cathode (37,38), with its associated heater, and a pre-ionisation electrode (39,40). Within the envelope 30, and at the junction between the three arms, is a cylindrical solenoid-type coil (41).

This thyratron operates in the following manner:

If, with the current flowing in the dashed line "left-hand" pathway (between the anode 34 and cathode 38), a magnetic field is generated by the solenoid coil 41 in a direction down into the paper (as viewed), then the electron/ion streams will be bent by the field to the right (as viewed).

With sufficient bending the ion stream will be diverted into the dotted "right-hand" pathway (between anode 34 and cathode 37), and the electrons lost to the walls. The diverted ions will then cause secondary electron emission at cathode 37, and thus the thyratron will have switched the current from one pathway to another—and from one lot of circuitry to the other.

Figure 2:
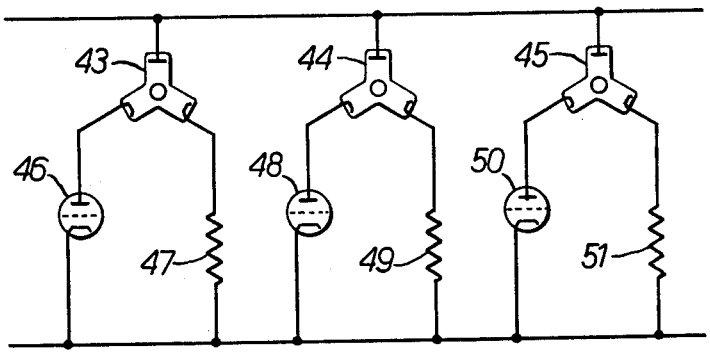
FIG. 2 is a schematic block diagram of a circuit employing a thyratron of the FIG. 1 type.

A simple practical application of a thyratron of the type shown in FIG. 1 is represented in FIG. 2. An array of valves (46,48 and 50) each paralleled by a dummy load (47, 49 and 51) is to be protected from internal arcing by a like array of double-cathode thyratrons (43,44 and 45). If an arc occurs in, say, valve 48, thyratron 44 is used to divert the current to dummy load 49 (which has a similar impedance to valve 48). This diversion means that the current through the valve is interrupted without switching off the H.T. supply to the whole system, and thus valves 46 and 50 will continue to run undisturbed.

When the arc has cleared, thyratron 44 is used to divert the current back to valve 48.

I claim:

1. A thyratron having:

two cathodes and one anode, such that there are two distinct current pathways through the thyratron having a common section of significant length; and switching means for switching the current between the current pathways, which switching means comprises in part magnetic-field-producing means in operation producing a plasma-diverting magnetic field acting at the cathode end of the common pathway section, with the position and direction of the field lying across the common pathway section so as to divert the current-carrying plasma away from one and towards the other of the pathways, whereby the current flowing along the one pathway is extinguished and replaced by a current flowing along the other pathway.

2. A thyratron as claimed in claim 1, wherein the magnetic field source itself lies within the current pathway at the cathode end of the common pathway section.

3. A thyratron as claimed in claim 2, wherein the source of the magnetic field is an electromagnet coil, and the coil is suitably insulated by a covering of a nonconductive material impervious to the ambient conditions, is an open, loosely-wound coil having between adjacent turns gaps which are at least comparable in size to the size of the coil wire and its insulating covering, and is located with its axis slightly to one side of the pathway centre line so as to cause the least possible physical obstruction to the plasma.

4. A thyratron as claimed in claim 1, which comprises: an envelope containing a gas or vapour filling; a common anode and two cathodes housed within the envelope so as to define two current pathways having a common section of significant length; a plurality of control and/or screen members disposed within the envelope in the current pathway between each anode and cathode pair, and providing two or more apertures through which in operation a plasma-borne current can flow between that anode and cathode pair along that pathway; and means for producing a plasma-diverting magnetic field acting at the cathode end of the common current pathway section and so as to divert the current-carrying plasma away from one and towards the other of the pathways, whereby the current flowing along the one pathway is extinguished and replaced by a current flowing along the other pathway.

5. A thyratron as claimed in claim 1, wherein the magnetic field is concentrated at the cathode end of the common pathway section.

* * * * *